US005491860A

United States Patent [19]

Bray et al.

[11] Patent Number: 5,491,860

[45] Date of Patent: Feb. 20, 1996

[54] METHOD OF CONTRUCTING A SLIPPER

[75] Inventors: Jr., Walter T. Bray, Reynoldsburg; Theresa Stewart, Columbus, both of Ohio

[73] Assignee: R. G. Barry Corporation, Ohio

[21] Appl. No.: 394,492

[22] Filed: Feb. 27, 1995

Related U.S. Application Data

[62] Division of Ser. No. 138,707, Oct. 18, 1993, Pat. No. 5,392,532.

[51] Int. Cl.[6] ..... A43D 9/00

[52] U.S. Cl. ..... 12/142 A; 36/17 A; 36/10

[58] Field of Search ..... 12/142 R, 142 A, 12/142 ML, 142 RS, 142 S, 142 T, 146 B, 1146 BP, 146 BR, 148, 142 G; 36/11, 5, 10, 106, 12, 17 R, 17 A, 19 R, 19 A, 25 R, 30 R, 9 R, 11, 16, 18, 21

[56] References Cited

U.S. PATENT DOCUMENTS

| | | | |
|---|---|---|---|
| D. 326,181 | 5/1992 | Katz et al. . | |
| D. 347,518 | 6/1994 | Stewart . | |
| 992,221 | 5/1911 | Loewenbach . | |
| 1,770,698 | 7/1930 | Horowitz . | |
| 1,916,067 | 6/1933 | Naidor . | |
| 3,051,971 | 9/1962 | Westberg . | |
| 3,095,656 | 7/1963 | Lipare . | |
| 4,145,822 | 3/1979 | Mitchell et al. . | |
| 4,899,412 | 2/1990 | Ganon . | |
| 5,012,541 | 5/1991 | Ganon . | |
| 5,033,144 | 7/1991 | Ganon . | |
| 5,392,532 | 2/1995 | Bray, Jr. et al. | 36/11.5 |

FOREIGN PATENT DOCUMENTS

| | | |
|---|---|---|
| 5-111403 | 5/1993 | Japan . |

OTHER PUBLICATIONS

Document entitled S. Goldberg & Co., Inc. Catalog, Spring 1970, Style 495.

Document entitled S. Goldberg & Co., Inc. Catalog, Spring 1975, Style 5974.

Document entitled S. Goldberg & Co., Inc. Catalog, Spring 1980, Style 5991.

Document entitled S. Goldberg & Co., Inc. Catalog, Fall 1983, Styles 4941, 5971.

Document entitled S. Goldberg and Son, Inc. Catalog, Fall 1984, Styles L502, C101.

Document entitled S. Goldberg & Co., Inc. Catalog, Fall 1990, Style 6887.

Document entitled S. Goldberg & Co., Inc. Catalog, Fall 1993, Styles 506, 509, 511, 5110.

*Primary Examiner*—Thomas P. Hilliard

*Attorney, Agent, or Firm*—Merchant, Gould, Smith, Edell, Welter & Schmidt

[57] ABSTRACT

A slipper having a clog appearance is constructed with a soft fabric upper and a flexible molded outsole. The construction technique hides fabric seams.

2 Claims, 8 Drawing Sheets

METHOD OF CONTRUCTING A SLIPPER

This is a division, of application Ser. No. 08/138,707, filed Oct. 18, 1993, now Pat. No. 5,392,

BACKGROUND OF THE INVENTION

1. Field of the Invention

This invention pertains to footwear. More particularly, this invention pertains to a slipper having a turned heel seat construction.

2. Background of the Invention

The footwear industry is an old and crowded art. The industry is constantly attempting to design new products with aesthetic appeal as well as being comfortable, and having ease of construction.

For a long time, clog-style slippers have been widely used. Traditional clog-style slippers are constructed of a stiff, generally inflexible material (such as leather) which are lasted or tacked to a heavy, dense outsole material (such as wood). The wearer's foot was required to conform to the molded insole of the clog. Clogs could be uncomfortable but had a well-received appearance of the sides of the vamp extending rearwardly towards the heel.

It is an object of the present invention to provide a clog-style slipper which offers traditional styling of a clog slipper in a lightweight, flexible washable product.

SUMMARY OF THE INVENTION

According to the preferred embodiment of the present invention an article of footwear is constructed by forming a molded, pliable outsole. A vamp of flexible material is secured to an insole of flexible material. A strap is secured to both the vamp and the insole. The strap is turned for the strap to cover raw edges of the vamp in the insole. The insole is aligned against the outsole and secured thereto at a heel portion. The insole and outsole are turned for the bottom surface of the insole to oppose a cavity defined by the outsole. A resilient cushioned filler is placed within the cavity and the toe portion of the insole and outsole are secured to close the cavity.

DESCRIPTION OF THE PREFERRED EMBODIMENT

Referring now to the several drawing figures in which identical elements are numbered identically throughout, a brief description of the preferred embodiment of the present invention will now be provided.

Figure 1:
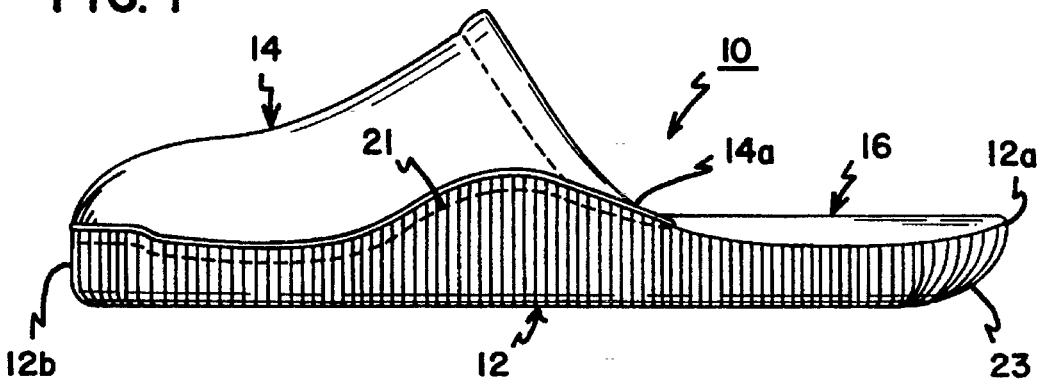
FIG. 1 is a side elevation view of slipper manufactured according to the present invention.

Referring now to FIG. 1, a slipper 10 constructed according to the present invention is shown. The slipper 10 includes an outsole 12, a vamp 14 and an insole 16. As shown in FIG. 1, the slipper 10 presents the appearance of a traditional clog slipper with the vamp 14 presenting a side edge 14*a* which extends rearwardly towards a heel end 12*a* of the outsole 12. The slipper 10 is illustrated in FIG. 1 for purposes of understanding the method of construction which will follow. Also, for ease of illustration of the method of construction, the various elements of the slipper will now be described.

Figure 2:
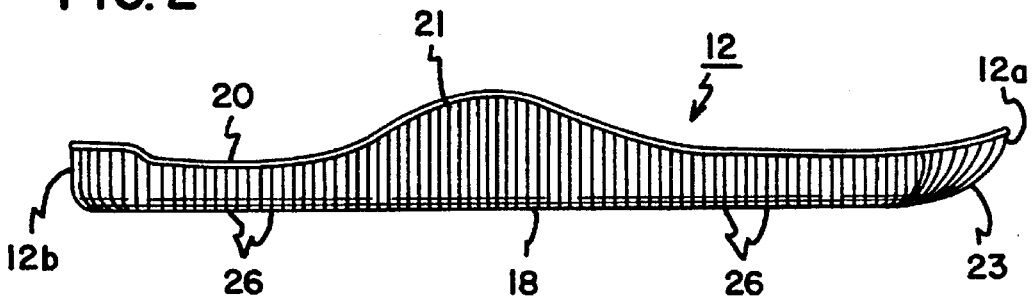
FIG. 2 is a side elevation view of an outsole for use with the present invention.

Referring now to FIG. 2, the outsole 12 is shown as a resilient molded outsole which, in its rest position, has a generally flat bottom portion 18 extending from heel end 12*a* to toe end 12*b*. A peripheral side wall 20 extends upwardly from the flat portion 18. The wall 20 defines an internal cavity 24 sized to receive a resilient filler as will be described. Shown best in FIG. 2, the wall 20 is provided with a raised portion 21 in the instep area of the sole for lateral support for the wearer. The side wall 20*d* at heel 12*a* extends upwardly in a smooth arc illustrated at 23. The side wall 20*c* at the toe 12*b* extends generally straight up from the flat area 18.

Figure 3:
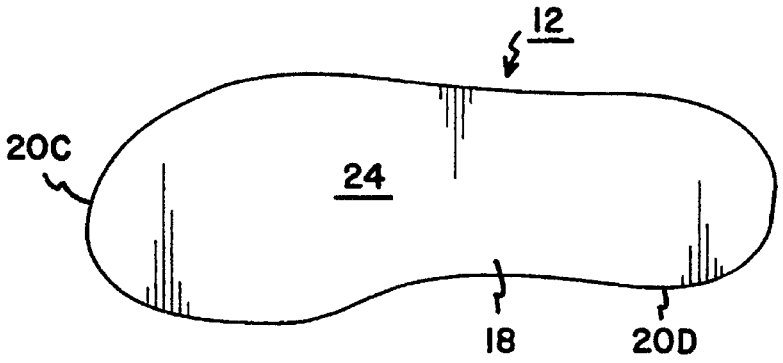
FIG. 3 is a sectional plan view of a wall of the outsole of the present invention of FIG. 3; (Turned 180° as comparable to FIG. 3).
Figure 3A:
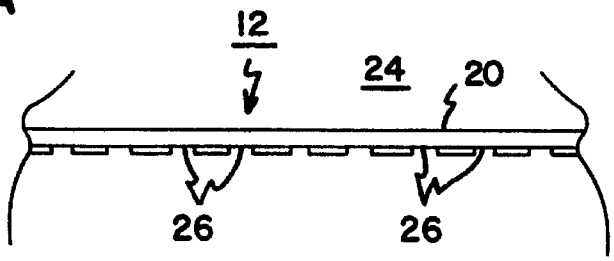
FIG. 3A is a top plan view of the outsole of FIG. 2.

The exterior surface of the outsole 12 is grooved as best shown in FIGS. 2 and 3A (FIG. 3A being a schematic top plan view of the outsole 20 with a plurality of grooves 26. The groove pattern of the outsole 12 permits the outsole to conform completely to the wearer's foot while providing traction during use. The radius 23 of the wall 20*d* near heel end 12*a* provides the clog slipper with a distinctively feminine look and a soft, cushioney heel periphery. It also enables the heel to be flattened during construction as described below.

Figure 4:
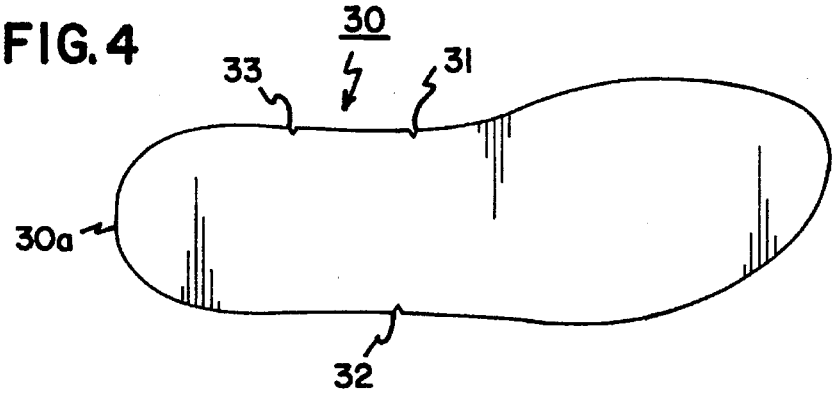
FIG. 4 is a top plan view of a foam sole filler for use with the present invention.

In FIG. 4, a resilient foam sole filler 30 is shown. The foam sole filler 30 conforms to the shape of the internal cavity 24 such that the foam sole filler 30 may be placed within the cavity 24 adjacent the flat surface 18. The foam sole filler 30 is provided with a thickness sized such that filler 30 does not extend above the upper peripheral walls 20 upon insertion into the internal cavity 24. The sole filler 30 is provided with notches 31, 32, 33. Notches 31, 32 are provided on the opposite sides of the foam sole filler 30 in the instep area. Notch 33 is provided on the inside side of the foam filler 30 between the heel 30*a* and notch 32. Notches 31–33 provide locations to assist in stitching of the various components as will be described.

Figure 5:
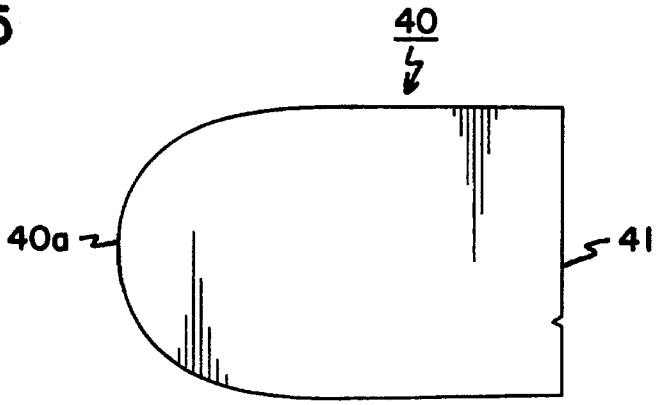
FIG. 5 is a top plan view of a foam heel filler for use with the present invention.
Figure 6:
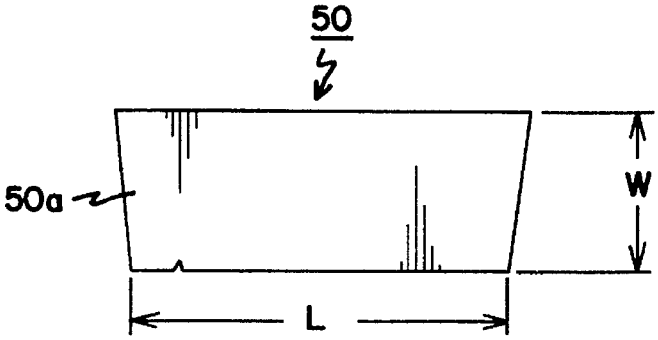
FIG. 6 is a top plan view of a heel strip fabric for use with the present invention.

With reference now to FIG. 5, a heel filler 40 is provided. The heel filler 40 is also formed of resilient foam material and is sized such that its combined thickness with the thickness of sole filler 30 permits the heel filler 40 to extend above wall 20 in the region of the heel 12*a* . The heel filler 40 extends from a heel end 40*a* conformed with the wall of the outsole at heel 12*a* and extends to a transverse edge 41. Upon placement of the heel filler 40 on the filler 30, edge 40*a* lies near edge 30*a* while edge 41 generally extends between notches 31, 32.

For use in manufacturing the slipper of the present invention, a heel strip 50 is provided. The heel strip 50 is a strip of fabric 50 having a length L sufficient to span the width of the foot such as the length between notches 31, 32 of sole filler 30.

Figure 7:
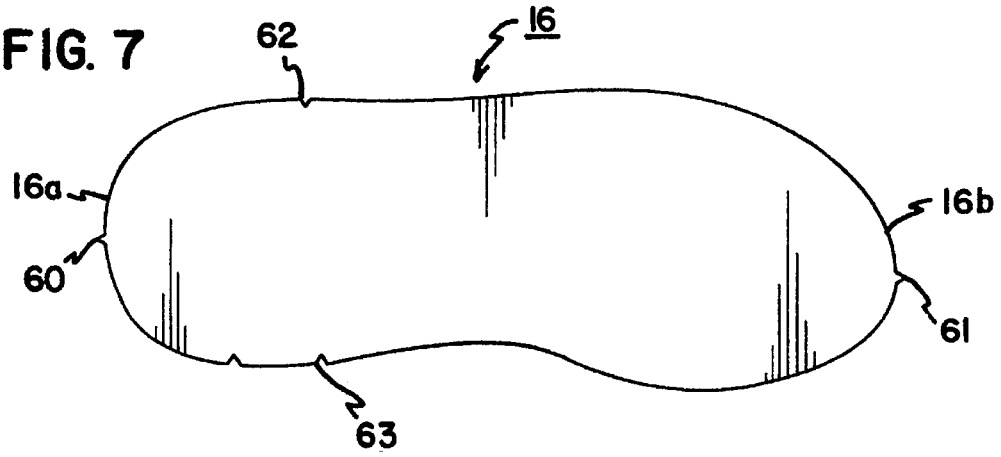
FIG. 7 is a top plan view of a fabric insole for use with the present invention.

FIG. 7 illustrates insole 16 in a top plan view. The insole 16 is preferably formed of a terry-cloth material on its upper surface with a cloth fabric liner on a bottom surface. The insole 16 generally conforms with the shape of a foot and is sized to cover the internal cavity 24 of the outsole 12. The insole 16 extends from a heel end 16*a* to a toe end 16*b*. Centrally positioned on heel end 16*a* is a first tab 60. Similarly, a second tab 61 is centrally positioned on toe end 16*b*. Tabs 60, 61 assist in locating various components prior to stitching as will be described. Notches 62, 63 are formed on opposite sides of the insole 16 adjacent the beginning of the heel area and to define the beginning of the heel area of the insole 16. The notches 62, 63 assist in locating stitching requirements.

Figure 8:
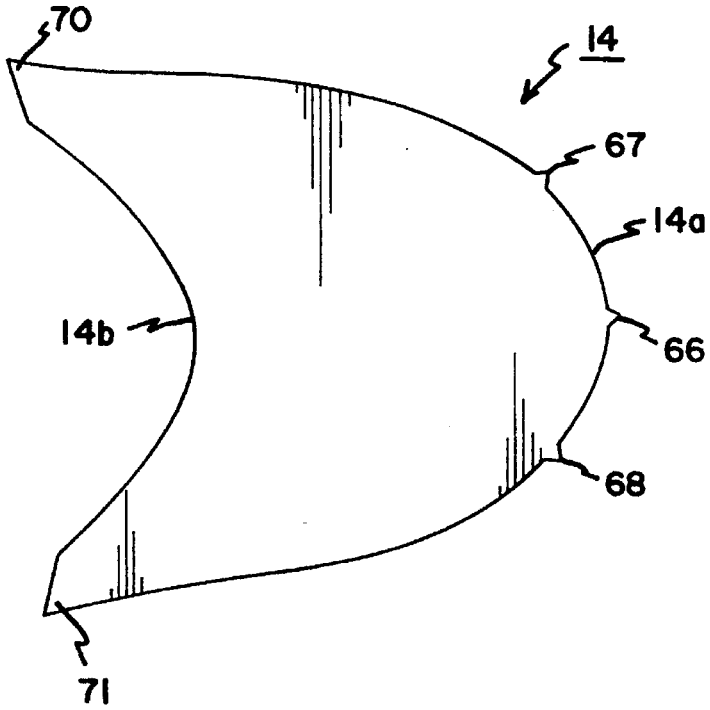
FIG. 8 is a top plan view of a fabric vamp for use with the present invention.

FIG. 8 shows vamp 14. Vamp 14 is preferably formed of a terry-cloth material such as insole 16. The vamp includes a toe end 14*a* and an ankle end 14*b*. Centrally positioned on toe end 14*a* is a tab 66. Also, tabs 67, 68 are provided on the toe area 14*a* on opposite sides of tab 66. Tabs 66, 67, 68 assist in locating the vamp 14 and other components and for providing identification for starting and stopping stitching as will be described. The vamp 14 includes extending side walls 70 which flare rearwardly of the ankle area 14*b*.

Having thus described the components of the novel slipper, a novel construction technique will now be provided.

Figure 9:
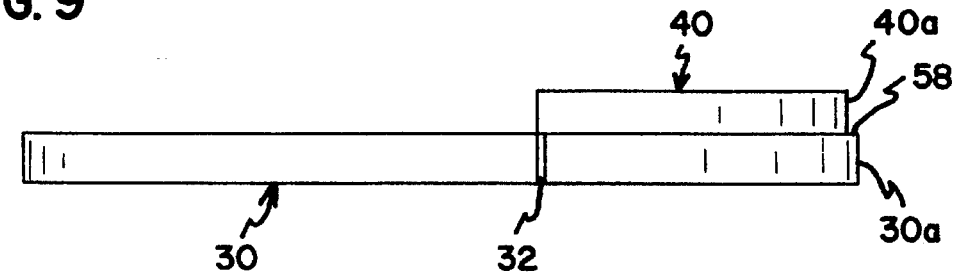
FIG. 9 is a side elevation view of an assembled heel filler and sole filler.

With reference now to FIG. 9, construction of the slipper begins with placement of the heel filler 40 on the sole filler 30 and adhering fillers 40, 30 with glue. The heel filler 40 is positioned for edge 41 to align with notches 31 and 32. The reader will note that the length of the heel filler 40 is downsized such that there is a small recess 58 between the heel end 40*a* of the heel filler 40 and the heel end 30*a* of the sole filler 30. The use of the heel filler 40 in combination with the sole filler 30 is to completely fill the heel radius 23 with filler material eliminating void spaces in the heel portion 12*a* of the finished slipper 10. Also, the use of doubled material in the heel of the slipper provides added cushion for support in the heel area.

Figure 10:
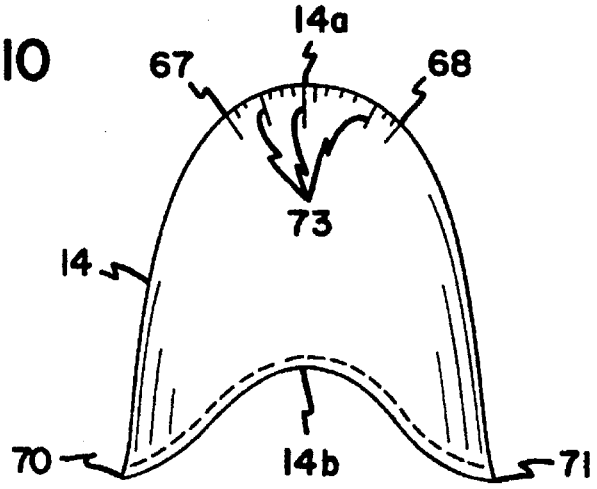
FIG. 10 is a top plan view of a shirred vamp.
Figure 11:
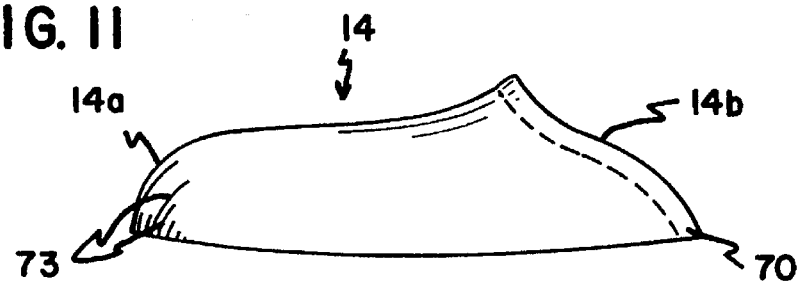
FIG. 11 is a side elevation of the vamp of FIG. 10.

With reference now to FIGS. 10 and 11, the toe area 14*a* of vamp 14 is shirred between notches 68, 67. Shirring is provided by stitching lines 73. Shirring is recognized in the industry as a bunching of the fabric in the toe area and stitching to retain the bunched look. The shirring operation permits the use of a soft, washable fabric for the vamp 14 while providing the wearer with comfort and foot conforming room in the toe area. Namely, the shirring raises the toe area 14*a* of the vamp 14 to provide substantial volume to receive the toes of the user. Also, the use of shirring with a flexible, soft material such as the terry cloth of the vamp, enables the overall product to conform to the wearer's foot without becoming restrictive across the toes of the foot. With the vamp 14 being shirred, the various components of the shoe can now be assembled.

Figure 12:
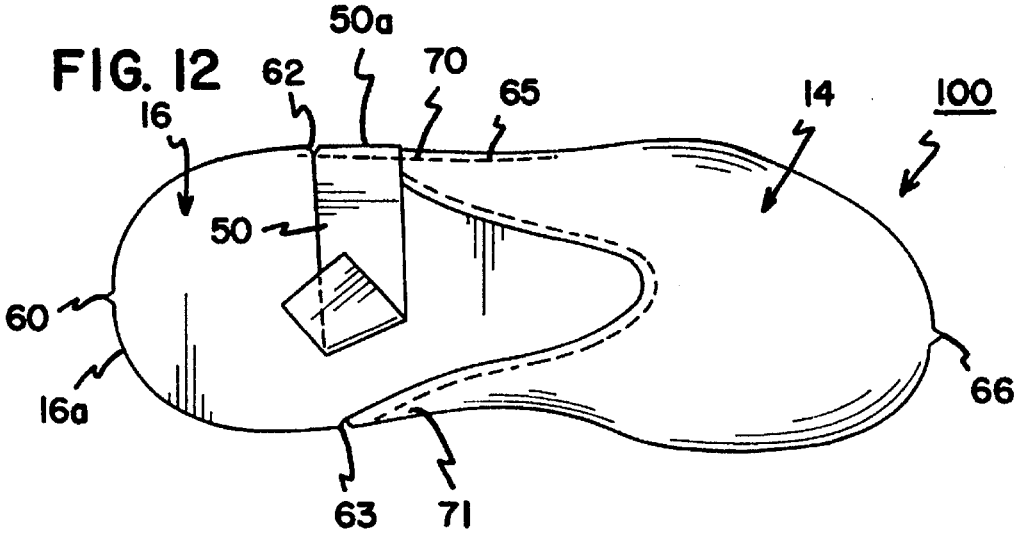
FIG. 12 is a top plan view showing partial assembly of the vamp, insole and heel strip to create a shoe upper.

The assembly operation begins with the alignment of the fabric heel strip 50 and the vamp 14 with the outstep side of the insole 16. This is illustrated in FIG. 12. In FIG. 12, the insole 16 and vamp 14 are positioned "right side out". In other words, the bottom of the vamp 14 faces the top or finished surface of the insole 16. The vamp edge 70 is aligned with notch 62. Similarly, vamp edge 71 is aligned with notch 63. Vamp tab 66 is aligned with insole tab 61. Also, a side edge 50*a* of the strip 50 is positioned to cover a terminal end of edge 70 up to notch 62. The opposite end of the heel strip 50 is aligned with notch 63 and covers a terminal end of edge 71.

Figure 13:
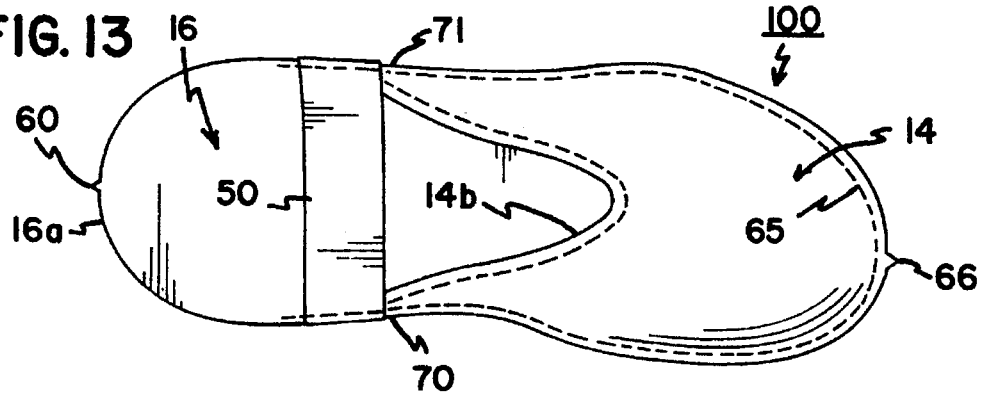
FIG. 13 is a top plan view of a completed upper.
Figure 14:
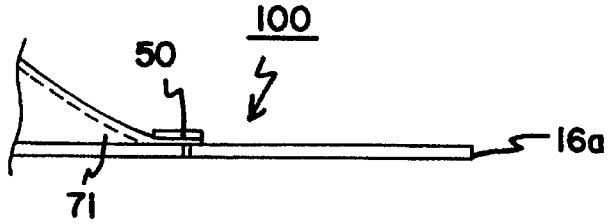
FIG. 14 is a side elevation view of a section of the upper of FIG. 13.

Beginning at notch 62, an operator then stitches to provide a stitching 65 which continues along the fabric strip 50 and the vamp 14 to stitch both the fabric strip 50 and the vamp 14 to the insole 16 to form a completed upper 100. In doing so, the operator aligns the tab 66 of the vamp with the tab 61 of the insole to ensure that the vamp 14 is properly aligned on the insole 16. The final stitched upper 100 is illustrated in FIGS. 13 and 14. The reader will note that the fabric strip 50 is extending partially over and covering edges 70, 71 of the vamp 14. So constructed, the subassembly 100 of the vamp, insole and fabric strip 50 is partially inverted since the fabric strip 50 is now exposed above the finished surface of the insole 16.

Figure 14A:
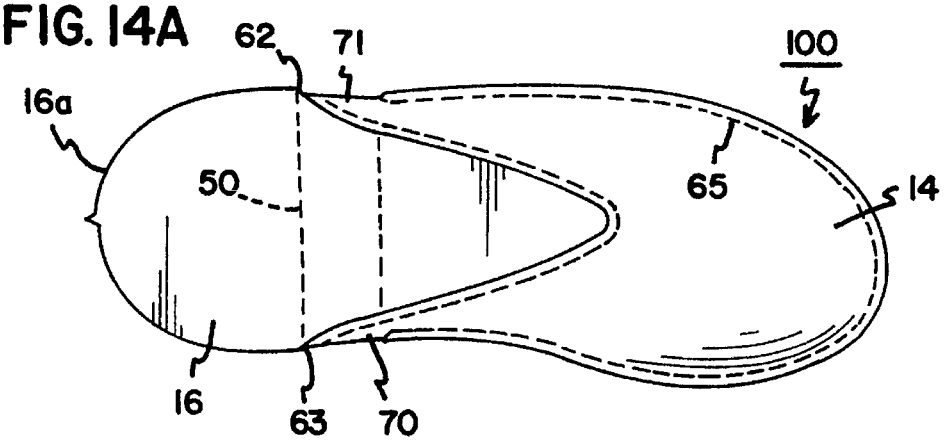
FIG. 14A is a top plan view of the upper.
Figure 15:
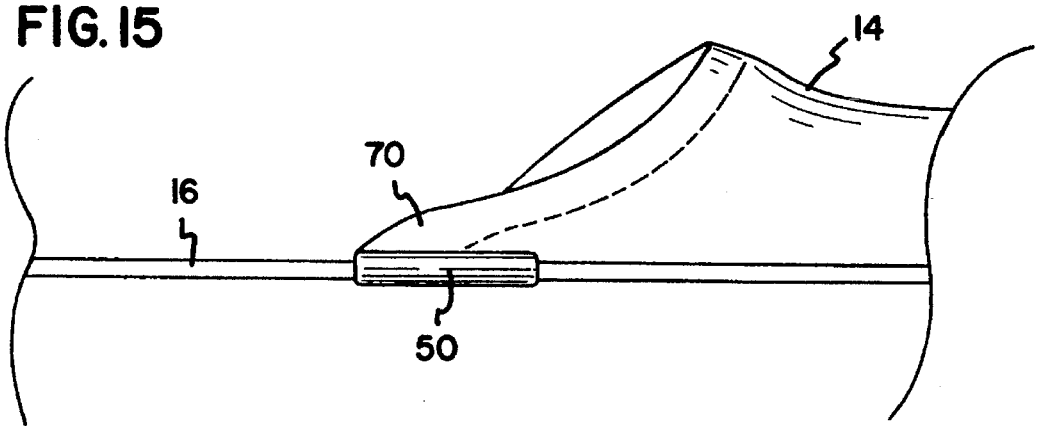
FIG. 15 is a side elevation view of a section of the upper of FIG. 14A.
Figure 15A:
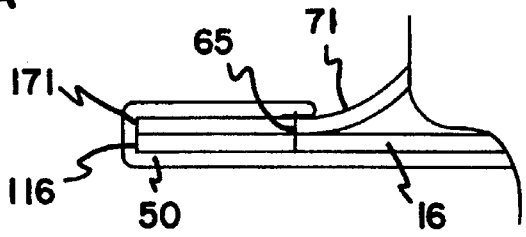
FIG. 15A is a partial cross-sectional view of the upper of FIG. 14A.

After this assembly 100 has been completed, the heel portion 16*a* of the insole 16 is passed beneath the fabric strip 50 such that the fabric strip 50 (shown in phantom in FIG. 14A) is now turned to face the bottom side of the insole 16 as illustrated in FIG. 14A. The reader will note that the fabric strip 50 covers the raw stitching edges at terminal ends 71, 70 under the insole so that they are not exposed (for example, edges 71 and 116 of edge 171 and insole 16 shown in FIG. 15A). As will become apparent, the fabric strip 50 also assists future assembly without incurring the risk of the vamp 14 pulling out of the insole 16. Finally, the turned fabric strip 50 allows for an alignment point in the next step of construction.

Figure 16:
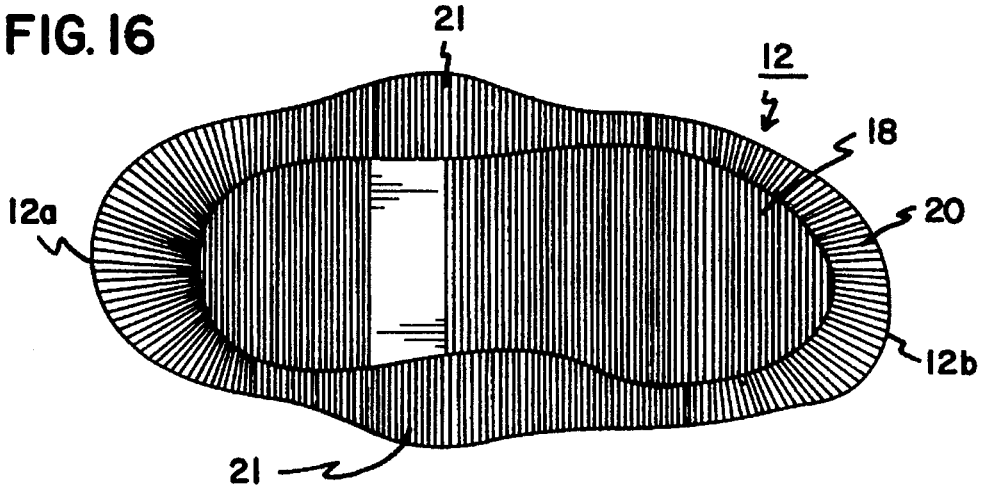
FIG. 16 is a bottom plan view of the molded outsole shown flattened prior to assembly to the upper of FIG. 13.
Figure 17:
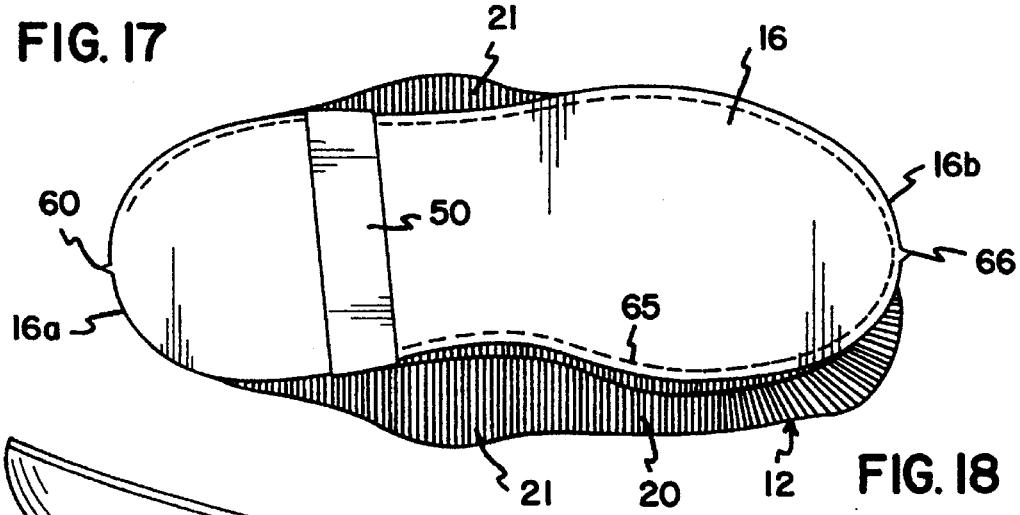
FIG. 17 shows the upper of FIG. 13 in an alignment and overlying relation on the outsole of FIG. 16.

With reference now to FIG. 16, the heel area 16A of the laid flat with the bottom grooved surface 18 exposed upwardly, FIG. 16 representing a plan view showing the bottom grooved surface as the outsole is laid flat such that the outer wall 20 is in generally planar alignment with wall 18. The completed upper 100 of FIG. 14A is laid on top of the flattened outsole 12 with the heel area 12*a* of the outsole 12 is aligned with the heel area 16*a* of the upper 100. The upper 100 is laid "inside out". In other words, the finished terry cloth of the vamp 14 and the insole 16 are positioned opposing the bottom exterior surface of the outsole 12 as shown in FIG. 17.

Figure 18:
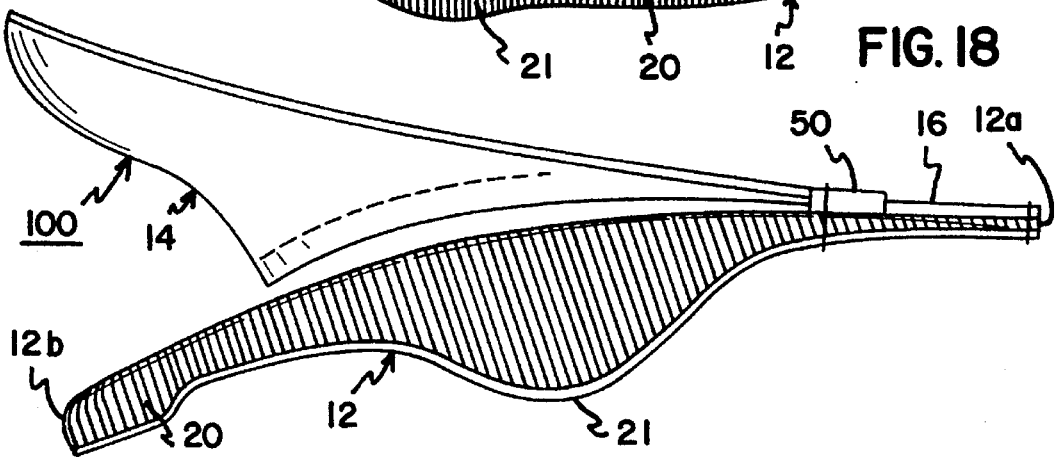
FIG. 18 is a side elevation view of the upper of FIG. 13 attached to the outsole of FIG. 16.
Figure 19:
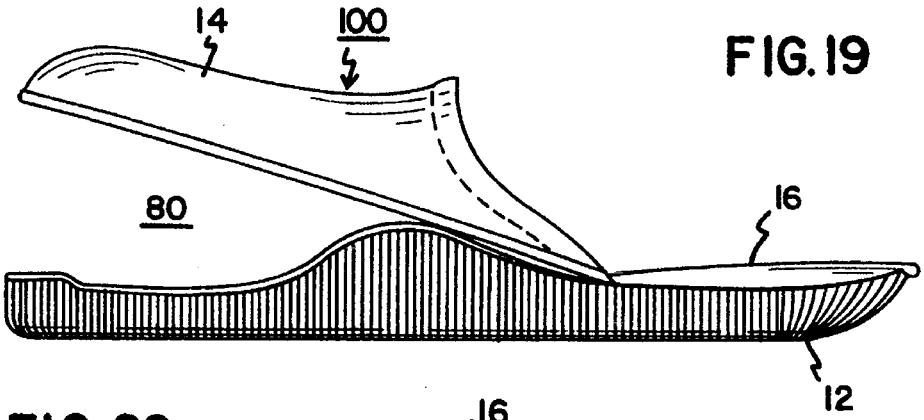
FIG. 19 is a view of the subassembly of FIG. 18 turned right side out.
Figure 20:
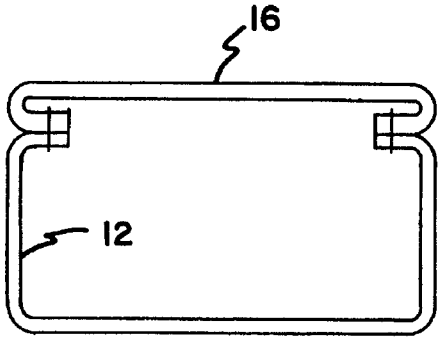
FIG. 20 is a cross-sectional view of the assembly of FIG. 19.

The operator then stitches the heel area 12*a* of the outsole 12 to the heel area 16*a* of the upper 100, i.e., between the edges of fabric strip 50 at notches 62 and 63. Completion of this stitching operation is best illustrated in FIG. 18. This assembly is permitted by the flexible radius 23 of the molded outsole 12 which permits the molded outsole 12 to be laid flat for stitching. Following the completion of the subassembly through FIG. 18, the upper and the outsole are turned as shown in FIG. 19. By turning the upper 100 and the outsole 12 right side out, the raw edges of the stitching of the heel 16*a* of the upper 100 to the outsole 12 are now turned and concealed from view. This creates a soft, hidden seam around the heel circumference of the product as best shown in FIG. 20. This construction also eliminates the need to use the traditional slipper products.

Figure 21:
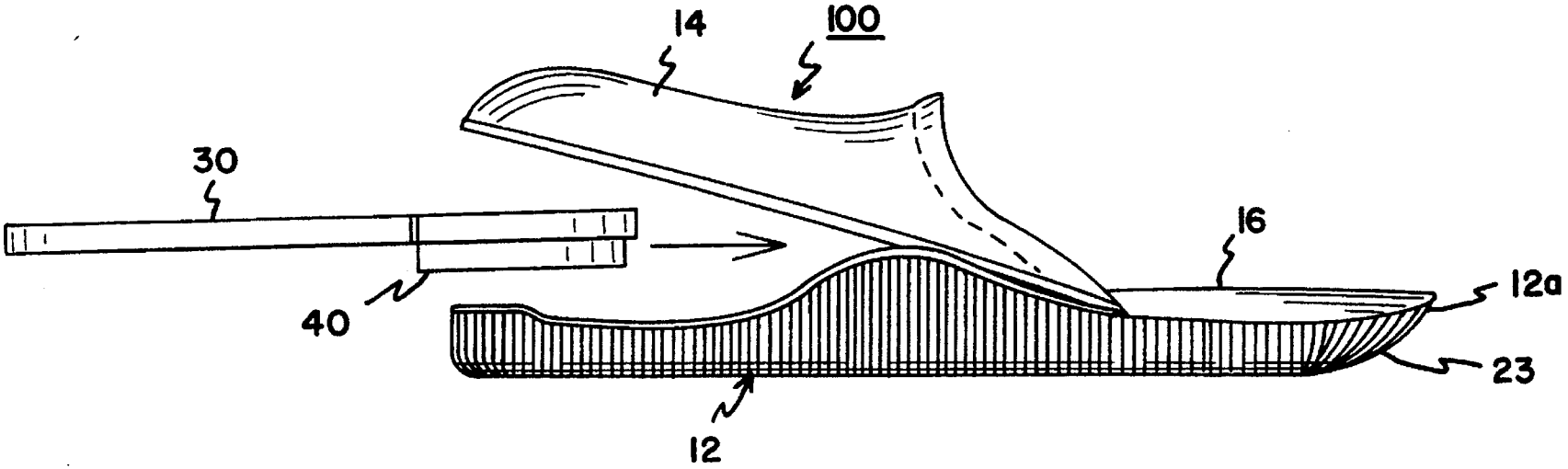
FIG. 21 is the view of the assembly of FIG. 19 showing insertion of a product filler.

As shown in FIG. 19, a pocket 80 is now defined between opposing surfaces of the outsole and upper 100. The product filler comprising the sole filler 30 and the heel filler 40 glued together is inserted into the pocket 80 as illustrated in FIG. 21. The heel filler 40 faces downwardly. As a result, the heel filler 40 and sole filler 30 fill in the heel radius 23 of the outsole 12 and heel circumference 12*a* of the outsole 12. Accordingly, full foam cushioning is provided in the product.

Figure 22:
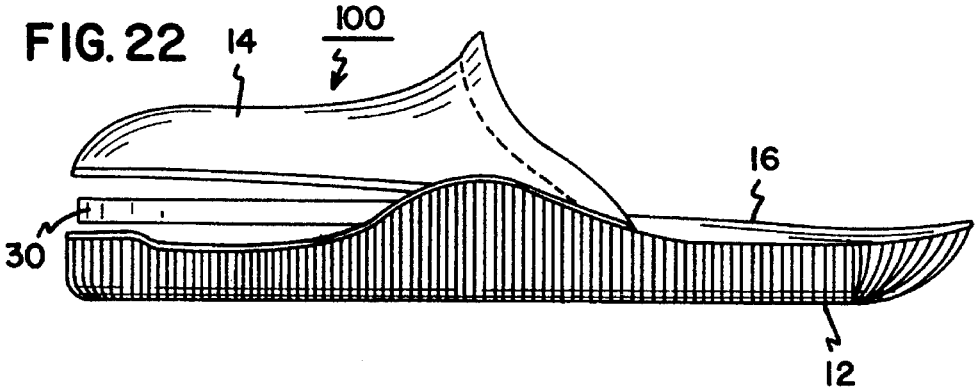
FIG. 22 is the product of FIG. 21 following insertion of the product filler.
Figure 23:
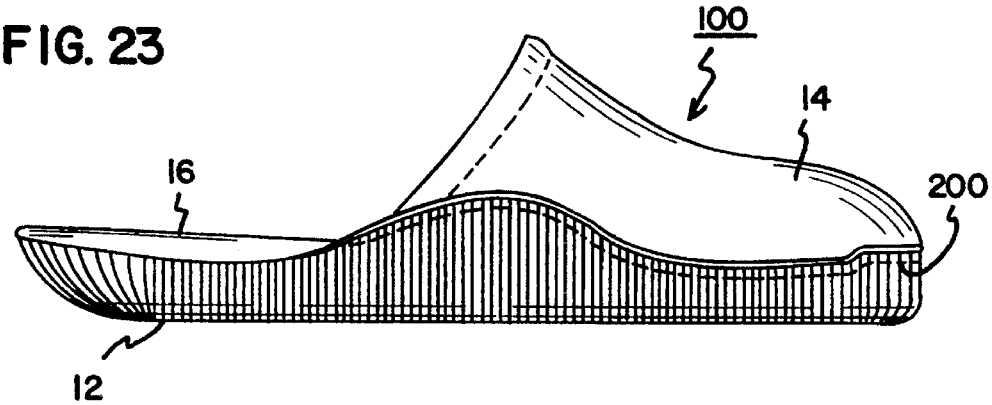
FIG. 23 shows the final product with final stitching of the upper to the outsole.

FIG. 22 illustrates complete construction of the product except for attachment of the upper to the sole in the toe area. The toe area of the upper is then placed into the internal cavity 24 such that the material of the vamp 14 opposes the material of the wall 20 of the outsole 12. So inserted, stitching 200 is provided as illustrated in FIG. 23 from the outstep, arch portion of the outsole. The stitching continues around the toe of the slipper to the foot of the vamp on the arch portion of the outsole and the instep of the product to create a final assembled product as shown in FIG. 1.

From the foregoing construction, the reader will appreciate that the molded outsole design, the filler material and the combination of the washable components as well as the unique assembly permits the creation of a clog-style slipper which is pleasing in appearance and comfortable to wear.

Having described the present invention in a preferred embodiment, it will be appreciated that modifications and equivalents of the disclosed concepts may become apparent to those skilled in the art. It is intended that such modifications and equivalents be included within the scope of the present invention.

What is claimed is:

1. A method for constructing an article of footwear comprising:

forming an outsole of molded, pliable material for said outsole to have a bottom and a peripheral wall, said wall and said bottom defining a cavity;

forming a resilient cushioned filler sized to be received within said cavity and substantially filling said cavity;

forming an insole of flexible fabric sized to cover said cavity;

forming a vamp of flexible material with said vamp having side edges extending from a toe portion of said vamp to terminal ends of said side edges;

securing said vamp to said insole and securing a strap to said vamp at a point of attachment of said terminal ends to said insole;

turning said strap to cover said terminal ends; aligning a finish surface of said insole against a bottom surface of said outsole and securing a heel portion of said outsole to a heel portion of said insole;

turning said insole and outsole for an inner surface of said insole to oppose said cavity and with a toe portion of said insole unattached to a toe portion of said outsole to define an access opening to said cavity;

inserting said filler through said access opening into said cavity; and closing said access opening.

2. A method according to claim 1 wherein said molded, pliable material is selected for said wall of said outsole to be flexible for said outsole to be urged to a substantially flat position with said wall generally co-planar with said bottom, said method including the step of holding said wall in generally co-planar alignment with said bottom during said aligning of said bottom surface with said insole.

* * * * *